US005396010A

United States Patent [19]

Harandi et al.

[11] Patent Number: 5,396,010

[45] Date of Patent: Mar. 7, 1995

[54] HEAVY NAPHTHA UPGRADING

[75] Inventors: Mohsen N. Harandi, Langhorne, Pa.; Roger A. Morrison, Lambertville, N.J.

[73] Assignee: Mobil Oil Corporation, Fairfax, Va.

[21] Appl. No.: 106,689

[22] Filed: Aug. 16, 1993

[51] Int. Cl.[6] ..... C07C 6/00; C10G 47/04; C10G 51/00

[52] U.S. Cl. ..... 585/418; 585/322; 208/111; 208/74

[58] Field of Search ..... 208/16, 57, 59, 58, 208/60, 63, 64, 65, 66, 69, 70, 134, 135, 141, 209, 111, 74; 585/319, 322, 418, 419

[56] References Cited

U.S. PATENT DOCUMENTS 2,886,508 5/1959 Hess et al. .
3,114,696 12/1963 Weisz .
3,395,094 7/1968 Weisz .
3,729,409 4/1973 Chen .
3,759,821 9/1973 Brennan et al. ..... 208/93
3,767,568 10/1973 Chen .
3,923,641 12/1975 Morrison .
3,928,174 12/1975 Bonacci et al. ..... 208/80
3,945,913 3/1976 Brennan et al. .
4,078,990 3/1978 Brennan et al. .
4,211,886 7/1980 Tabak et al. ..... 585/321
4,224,141 9/1980 Morrison et al. ..... 208/134
5,143,596 9/1992 Maxwell et al. ..... 208/89

*Primary Examiner*—Asok Pal
*Assistant Examiner*—Bekir L. Yildirim
*Attorney, Agent, or Firm*—Alexander J. McKillop; Malcolm D. Keen; Jessica M. Sinnott

[57] ABSTRACT

A fluid catalytically cracked heavy naphtha containing a substantial proportion of preferably more than 90% $C_9+$ hydrocarbons is contacted with a reformate heavy naphtha containing a substantial proportion of $C_9+$ hydrocarbons and, optionally, a benzene-rich stream, over a catalyst of acidic functionality, preferably unsteamed ZSM-5, under transalkylation reaction conditions of temperature and pressure to produce a gasoline boiling range product, boiling below 300° F., having a reduced sulfur content and an increased octane number. In one mode of operation the reformate is cascaded from the reformer as the conditions of reaction are compatible with the conditions established in the reformer.

29 Claims, 1 Drawing Sheet

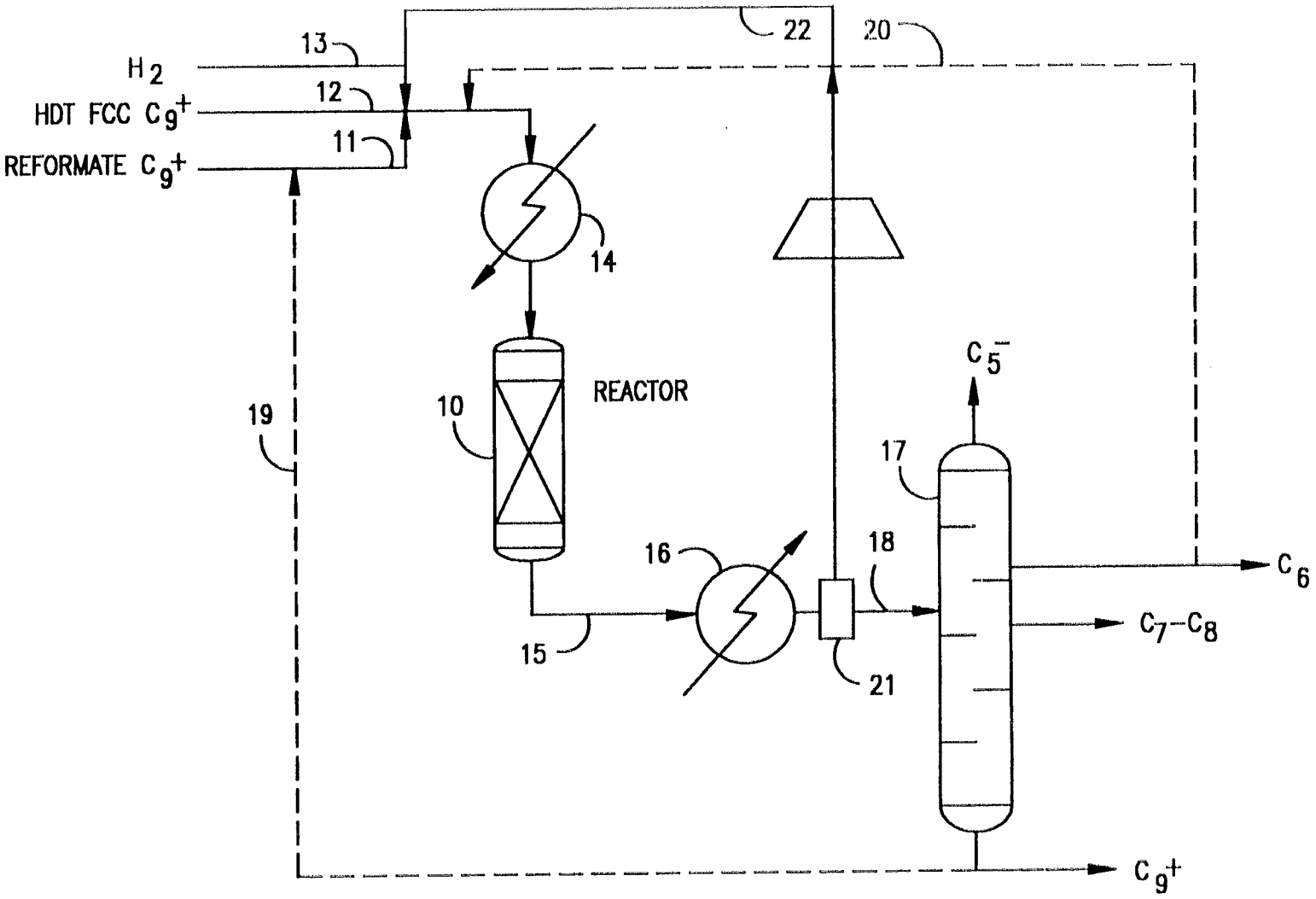
$H_2$
HDT FCC $C_9^+$
REFORMATE $C_9^+$
13
12
11
14
REACTOR
10
15
16
22
20
21
18
17
19
$C_5^-$
$C_6$
$C_7-C_8$
$C_9^+$

HEAVY NAPHTHA UPGRADING

FIELD OF THE INVENTION

The invention relates to a process for converting highly aromatic $C_9+$ or heavier fractions to achieve a gasoline boiling range product.

BACKGROUND OF THE INVENTION

The conversion of catalytically cracked heavy naphthas, which, typically, begin to boil within the gasoline boiling range, about 285° F. (140° C.), and finish boiling in the distillate range, e.g. 400° F. (204° C.), to materials which begin and end boiling within the gasoline boiling range, $C_5$ to 330° F., is important to refiners.

Aromatic heavy naphtha fractions such as fluid catalytically cracked (FCC) 300°–425° F. products are high in octane, but because they begin to boil above the gasoline end boiling range, and may contain a large proportion of sulfur impurities, they require further processing to become commercially valuable as gasoline. However, it is difficult to eliminate, or at least reduce, the properties which make them undesirable as gasoline, i.e. the high sulfur content and high boiling point, without compromising the high octane properties that make them desirable as gasoline.

Recently, it has been reported that lowering gasoline endpoint results in a product endpoint where, in a standard ASTM distillation, 90 volume percent of the gasoline distills below 300° F. ($T_{90}$) will reduce pollution. Meeting this $T_{90}$ permits only 10% of the hydrocarbons in gasoline to boil above 300° F. A significant boiling range conversion of heavy naphthas will be required to meet this goal.

U.S. Pat. No. 3,923,641 to Morrison discloses hydrocracking a $C_7+$ naphtha over zeolite beta at moderate temperatures and pressures to achieve a high yield of iso-$C_4$. However, the disclosure is silent on the yield and quality of higher hydrocarbons.

Upgrading a reformate by treatment with a crystalline aluminosilicate zeolite has been described. The described processes utilize the zeolite to selectively remove the normal paraffins and leave the aromatics and/or isoparaffins unchanged. U.S. Pat. No. 2,886,508 discloses contacting a reformate with a 5 angstrom unit aluminosilicate to selectively remove the normal paraffins by adsorption. U.S. Pat. No. 3,114,696 discloses cracking conditions to selectively crack the normal paraffins of a reformate. U.S. Pat. No. 3,395,094 discloses hydrocracking conditions to selectively crack the normal paraffins and also to preserve the aromatic components of the reformate feed. U.S. Pat. Nos. 3,767,568 and 3,729,409 describes treating a reformate feed over a zeolite, e.g., ZSM-5, in the presence of hydrogen, to improve the yield-octane number relationship of the reformate.

U.S. Pat. Nos. 3,945,913 and 4,078,990 both to Brennan et al. disclose production of benzene, toluene and xylenes (BTX) from alkyl aromatic feeds e.g. reformate fractions of at least nine carbon atoms over an acidic catalyst. A proposed catalyst is ZSM-5. U.S. Pat. No. 4,078,990 discloses that alkyl side chains of two or more carbon atoms rapidly dealkylate to near completion in the shallower portion of the catalyst bed which is first contacted by the feed. When this mixture, which is made up of methyl benzenes and alkanes of two or more carbon atoms, reaches the major portion of the bed, transalkylation and disproportionation reactions of the methyl benzene occur to equilibrium resulting in a product containing BTX. While this process takes advantage of the more easily dealkylated ethyl-branched aromatics of the reformate for purposes of producing methyl aromatics which can then undergo transalkylation and disproportionation reactions with the free alkyl groups, the process relies on a feed rich in ethyl-branched aromatics. There is no suggestion to utilize a feedstock which at the outset comprises methyl-branched aromatics which are more difficult to dealkylate than ethyl and higher alkyl-branched aromatics.

SUMMARY OF THE INVENTION

We have found that a catalytically cracked $C_9+$ heavy naphtha feed can be converted to gasoline boiling range hydrocarbons of reduced sulfur and nitrogen content and improved octane by treating the feed over a zeolite catalyst in the presence of hydrogen and a feedstream rich in alkyl-aromatics containing mostly $C_2+$ alkyl side chains, such as heavy naphtha reformate.

Catalytically cracked $C_9+$ heavy naphthas are troublesome to convert because they contain a large proportion of methyl-branched aromatics which are difficult to dealkylate. Heavy naphtha reformate, on the other hand, contains ethyl and propyl-side chain containing aromatics that are more easily dealkylated. We discovered a process in which reacting the methyl branched aromatics of the catalytically cracked heavy naphtha with lighter aromatics, which are readily formed through dealkylation of the heavy naphtha reformate, under transalkylation conditions, produces $C_7$ and $C_8$ aromatics, $C_7$ to $C_9$ aromatics or BTX (benzene toluene and xylenes) which are in the gasoline boiling range. We have also found that the process can achieve a reduction in product sulfur, if the feed is of high sulfur content, and an octane increase. Thus, the process may be utilized to desulfurize FCC heavy naphtha and improve octane which will obviate the need for reforming these fractions to the extent previously required to achieve the necessary refinery pool octane.

An object of this process is to produce gasoline from heavy naphthas.

A feature of this invention is to react a catalytically cracked heavy naphtha with a heavy naphtha reformate over a catalyst of acidic functionality to produce gasoline boiling range hydrocarbons.

An advantage of the invention is that the methyl branched aromatics of the catalytically cracked naphtha undergo a reaction with the heavy naphtha reformate to produce gasoline boiling range hydrocarbons.

The process will increase $C_2$–$C_4$ formation through dealkylation of the heavy naphtha reformate while minimizing production of methane from the demethylation of the catalytically cracked naphthas.

The process is also capable of recycling benzene to extinction or to a level acceptable for gasoline pool blending.

The process achieves a product meeting the end point or $T_{90}$ requirement of the gasoline pool. Typically the $T_{90}$ increases across the reactor, this is attributed to production of a small quantity of naphthalenes ($C_{13}+$). However, a significant portion of the $C_{10}+$ fraction of the feed which could not meet the $T_{90}$ specification when blended into the gasoline pool has been converted to $C_5$ to $C_9$ components which can meet the $T_{90}$ specification. The net overall affect of the process reduces a significant portion of the feed T-90 so that this fraction can be blended into the gasoline pool to increase the amount of high quality gasoline. If this process was not used, the refinery would produce more low quality distillate and less high quality gasoline.

BRIEF DESCRIPTION OF THE DRAWINGS

FIG. 1 is a simplified schematic process flow diagram of a preferred embodiment of the invention.

DETAILED DESCRIPTION

Feeds

The feed to the process comprises a combination of partially refined petroleum fractions, specifically, heavy naphthas in the kerosine boiling range, characterized by a boiling range of about 285° F. (140° C.) to about 650° F. (100° C. to 329° C.), more specifically about 300° F. to 450° F. (149° C. to 232° C.).

First Feed

A characteristic of catalytic cracking operations, e.g. in an FCC or TCC unit, is that the alkyl groups, generally bulky, relatively large alkyl groups (such as $C_5$–$C_6$ alkyls) which are attached to aromatic moieties in the feed are removed during the cracking reactions. These detached alkyl groups contribute to the gasoline fraction of the catalytic cracker. The aromatic moieties, such as benzene, naphthalene, benzothiophenes, dibenzothiophenes and polynuclear aromatics, such as anthracene and phenanthrene, form the high boiling products. The mechanisms of acid-catalyzed cracking and similar reactions remove side chains of greater than 5 carbons while leaving behind short chain alkyl groups, which are primarily methyl groups, but also some ethyl groups, and lesser amounts of propyl groups, on the aromatic moieties. This accounts for the substantial proportion of methyl-branched aromatics contained in the catalytically cracked naphtha.

This catalytically cracked refinery stream containing difficult to dealkylate methyl-branched aromatics and, optionally, sulfur-containing compounds, are used in this process. A catalytically cracked, i.e. TCC or FCC, preferably an FCC, heavy naphtha feed typically comprising sulfur impurities is specifically contemplated. The fraction, typically, exceeds 100 ppmw sulfur and in most cases 500 ppmw sulfur. A hydrotreated FCC naphtha containing low sulfur is also a suitable feed. The FCC heavy naphtha feed contemplated usually contains predominantly $C_9$+ hydrocarbons, although small amounts of lower hydrocarbons (e.g., $C_8$ and lower hydrocarbons) are not excluded from the feed. This fraction contains a significant proportion of $C_9$ to $C_{13}$ hydrocarbons which specifically means at least 80%, specifically about 85% to 95% of the feed will contain hydrocarbons in the range of $C_9$ to $C_{13}$, with, typically, no more than about 20%, more specifically about 15% $C_{13}$+ hydrocarbons, typically from about 60 to 100% $C_9$ to $C_{12}$ hydrocarbons. The FCC heavy naphtha contains a large proportion of methyl-branched aromatics as well as a complex mixture of methyl, ethyl, propyl, and isopropyl groups in addition to naphthalenes and methylnaphtalenes.

The catalytically cracked naphtha can be desulfurized by any conventional desulfurization process. The preferred desulfurization is catalytic hydrodesulfurization by effective contact of the feed with a hydrotreating catalyst, which is suitably a conventional hydrotreating catalyst such as a combination of a Group VI and a Group VIII metal on a suitable refractory support, such as alumina, under hydrotreating conditions. The Group VI metal is usually molybdenum or tungsten and the Group VIII metal usually nickel or cobalt. Combinations such as Ni-Mo, Ni-W, or Co-Mo are typical. The hydrotreating catalyst can also be an organic crystalline material such as zeolite and in this respect ZSM-5 is specifically contemplated. Under these conditions, at least some of the sulfur is separated from the feed molecules and converted to hydrogen sulfide to produce a hydrotreated intermediate product boiling in substantially the same boiling range as the feed, but which has a lower sulfur content and a similar or lower octane number than the feed.

The temperature of the hydrotreating step is suitably from about 400° to 850° F. (about 220° to 454° C.), preferably about 500° to 800° F. (about 260° to 427° C.) with the exact selection dependent on the desulfurization desired for a given feed and catalyst.

Since the feed is readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.). The extent of the desulfurization will depend on the feed sulfur content and, of course, on the product sulfur specification with the reaction parameters selected accordingly. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The particle size and the nature of the hydrotreating catalyst will usually be determined by the type of hydrotreating process which is being carried out, such as: a down-flow, liquid phase, fixed bed process; an upflow, fixed bed, trickle phase process; an ebullating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

The hydrotreated naphtha can be subsequently treated to restore octane as described in U.S. application Ser. No. 07/745,311 filed on Aug. 15, 1991 and Ser. No. 07/850,106 filed on Mar. 12, 1992 which are incorporated herein by reference.

Second Feed

A stream which contains ethyl and propyl-branched aromatics, which are more easily dealkylated than methyl-branched aromatics, is also used. A heavy naphtha reformate which is characterized by a relatively low sulfur content, as a result of pretreating prior to reforming, and the presence of ethyl and propyl branched aromatics is specifically contemplated. A reformate is a refinery stream produced by catalytically reforming a naphtha, usually boiling in the range of about 200° F. to 400° F. (93° C. to 204° C.). The reforming process typically occurs in a hydrogen atmosphere and high pressures in a moving-bed, fluid-bed or fixed-bed unit utilizing a mixed metal oxide catalyst (usually in the fluid and moving-bed units which are equipped with catalyst regeneration facilities) or a platinum-containing catalyst (in fixed-bed or moving-bed units). Catalytic reforming rearranges molecules in the gasoline boiling range to give higher octane molecules, at the expense of gasoline yield. The feed is converted by dehydrogenation, dehydroisomerization, dehydrocyclization, isomerization and limited hydrocracking reactions to an aromatic, high octane gasoline blending stock.

Typical reforming operating conditions include temperatures in the range of from about 800° F. to about 1000° F., pressures in the range of from atmospheric to about 700 psig and higher, specifically from about 100 to 600 psig and hydrogen-to-hydrocarbon ratio in the range of from about 0.5 to about 20, specifically from about 1 to 10.

A heavy reformate fraction, as mentioned above, is characterized by the presence of ethyl- and propyl-branched aromatics which occur as a result of paraffin dehydrocyclization. Following fractionation, the reformate heavy naphtha stream can be cascaded from the reformer to the process step of the instant invention. The heavy naphtha reformate feed contemplated usually contains predominantly $C_9+$ hydrocarbons, although small amounts of lower hydrocarbons (e.g. $C_8$ and lower hydrocarbons) are not excluded from the feed. This fraction contains a significant proportion of $C_9$ to $C_{13}$ hydrocarbons which specifically means at least 80% of the feed will contain hydrocarbons in the range of $C_9$ to $C_{13}$, with, typically, no more than about 10%, more specifically about 5% $C_{13}+$ hydrocarbons, typically from about 85 to 95% $C_9$ to $C_{12}$ hydrocarbons.

Optional Feed

A benzene-rich stream, or stream of relatively pure benzene, can be treated along with the catalytically cracked naphtha and reformate. The benzene-rich stream can be derived from a light reformate, recycle of $C_6$ materials from the reaction zone of this process or other aromatics-rich $C_6$-containing fraction. Preferably, the benzene-rich stream contains about 20–60% benzene.

Combined Feed

Any combination of the above feed streams are within the scope of this invention. However, the preferred combined feed should contain at least 25–75% of the first feed and at least 25–75% of the second feed with less than 20% of the feed being a refinery naphtha stream.

The first and second feeds are combined in a ratio of about 1 to 2, specifically, 1 to 1, with the optional benzene feed added to an amount of about 25 wt. % specifically, 10 to 20%, based on the total weight of the combined first and second feeds.

Usually, the combined feed will contain at least about 90 wt. % $C_9+$ hydrocarbons, although this will depend on the composition of the individual refinery streams. Thus, the $C_9+$ hydrocarbons can be as low as 70 wt. %.

Process Conditions

The sulfur-containing or hydrotreated catalytically cracked heavy naphtha along with the reformate heavy naphtha and, optionally, the benzene-rich streams are converted by contact with a catalyst of acidic functionality under conditions which convert a fraction of the feed to components which boil in the gasoline boiling range having a higher octane and generally a lower nitrogen and sulfur content than the feed to this step. The total wt. % conversion of $C_{10}+$ components will be at least about 20 wt. %, ranging from about 20 wt. % to about 80 wt. %.

A convenient mode of operation is to cascade the heavy naphtha reformate to this conversion step with the addition of the catalytically cracked heavy naphtha. Additionally, where desulfurization of the catalytically cracked naphtha is employed, advantage can be taken of the rise in temperature which takes place along the hydrodesulfurization reactor by also cascading the desulfurization effluent to this step. Preferably the desulfurization step and this step are in sequence and use the same $H_2$ circulation system and product recovery section. A furnace preheating the sulfurization effluent may also be employed. The desulfurization step feed preheat is preferably supplied by this step effluent.

The conditions used are selected to encourage hydrodealkylation of the heavy reformate aromatics to produce light aromatics which then transalkylate with the methyl-branched aromatics of the catalytically cracked heavy naphtha. The operating conditions are mild enough not to promote substantial hydrodealkylation of the methyl branched benzenes. Thus, the converted $C_9+$ aromatics of the catalytically cracked heavy naphtha are mostly converted to $C_7$ and $C_8$ aromatics and the $C_9+$ aromatics of the reformate heavy naphtha are converted to benzene, toluene and xylenes. Thus, a 300° F.+ (149° C.) naphtha fraction is converted to a more valuable gasoline boiling range fraction.

The conditions of reaction are those which are appropriate to produce the dealkylation and transalkylation reactions. Generally, the temperatures will range from about 500° F. to about 1000° F. (about 260° C. to about 528° C.), specifically from about 700° F. to about 850° F. (327° C. to 454° C.), more specifically from about 700° F. to about 800° F. (322° C. to 427° C.). The pressure in this process should be maintained to favor hydrodealkylation of the $C_9+$ reformate aromatics. Relatively moderate pressures have been found to be effective. Typically, pressures should be maintained from about 50 psig to about 1000 psig, specifically from about 100 to about 800 psig, more specifically from about 300 to about 600 psig.

Feeding heavy reformate usually requires separation of the heavy reformate fraction by distillation. Successful operation at the moderate temperatures and pressures described here implicate operation of the process in a completely integrated manner with the reformer. For example, this unit can share the unstabilized reformate fractionation section.

The space velocities, typically, range from about 0.1 to about 10 W.H.S.V., specifically from about 1 to about 5 W.H.S.V., more specifically from about 2 to about 4 W.H.S.V. Hydrogen to hydrocarbon ratios typically range from about 100 SCF/Bbl to 2,000 SCF/Bbl, specifically from 300 SCF/Bbl to 800 SCF/Bbl.

The catalytic material which is useful in this process is any catalyst of acidic functionality typically a solid, porous material. That is, the catalysts of this invention include crystalline aluminnosilicate zeolites and amorphous materials.

The preferred catalysts for this purpose are the intermediate pore size zeolitic behaving catalytic materials exemplified by those acid acting materials having the topology of intermediate pore size aluminosilicate zeolites. These zeolitic catalytic materials are exemplified by those which, in their aluminosilicate form would have a Constraint Index between about 2 and 12. Reference is here made to U.S. Pat. No. 4,784,745 for a definition of Constraint Index and a description of how this value is measured. This patent also discloses a substantial number of catalytic materials having the appropriate topology and the pore system structure to be useful in this service. A particularly preferred zeolite is unsteamed HZSM-5 having a silica-to-alumina mole ratio of about 70.

The preferred intermediate pore size aluminosilicate zeolites are those having the topology of ZSM-5, ZSM-11, ZSM-12, ZSM-22, ZSM-23, ZSM-35, ZSM-48, ZSM-50 or MCM-22. Zeolite MCM-22 is described in U.S. Pat. No. 4,954,325. Other catalytic materials having the appropriate acidic functionality may, however, be employed. A particular class of catalytic materials which may be used are, for example, the large pore size zeolite materials which have a Constraint Index of up to about 2 (in the aluminosilicate form). Zeolites of this type include mordenite, zeolite beta, faujasites such as zeolite Y and ZSM-4.

These materials are exemplary of the topology and pore structure of suitable acid-acting refractory solids; useful catalysts are not confined to the aluminosilicates and other refractory solid materials which have the desired acid activity, pore structure and topology may also be used. The zeolite designations referred to above, for example, define the topology only and do not restrict the compositions of the zeolitic-behaving catalytic components.

The amorphous acid catalysts are, typically, silica-alumina but other porous oxides are contemplated such as silica-zirconia, silica-thoria, silica-magnesia, zirconia, tungsten oxides and the like.

In any event, the catalyst should have sufficient acid activity to have hydrocracking activity with respect to the $C^{10}+$ hydrocarbons for selected $C^{10}+$ conversion.

One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980).

The catalyst used in the process suitably has an alpha activity of at least about 25, usually in the range of 50 to 800 and preferably at least about 100 to 300. Maximum catalyst activity is usually required to promote the desired reactions. This has been achieved here by using an unsteamed zeolite, preferably unsteamed ZSM-5.

The zeolite, will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina.

The catalyst used in this process may contain a metal hydrogenation function for improving catalyst aging or regenerability. Metals such as the Group VIII base metals or combinations can be used, for example nickel. Noble metals such as platinum or palladium may also be utilized. The catalyst may also contain aromatization metals such as Zn or Ga.

The particle size and the nature of the second conversion catalyst will usually be determined by the type of conversion process which is being carried out, such as: a down-flow, liquid phase, fixed bed process; an up-flow, fixed bed, liquid phase process; an ebullating, fixed fluidized bed liquid or gas phase process; or a liquid or gas phase, transport, fluidized bed process, as noted above, with the fixed-bed type of operation preferred.

The conditions of operation and the catalysts should be selected to result in a product slate in which the gasoline product octane is enhanced over the feed and to achieve at least the octane of the feed with a significant increase in the volumetric yield of the $C_{10}$- gasoline boiling range product. The conditions of operation should also be carried out to achieve a reduction in sulfur of the hydrotreated catalytically cracked naphtha of at least about 10%, specifically about 25% and higher.

Additionally, the conditions of operation should be conducted to achieve a 5 to 50% increase in the proportion of $C_7$ and $C_8$ hydrocarbons in the product over at least the $C_7$ and $C_8$ hydrocarbons in the feed.

Process Configuration

FIG. 1 is a simplified schematic flow diagram of a typical process configuration. A $C_9+$ reformate is passed to the reaction zone 10 via line 11 along with a hydrotreated $C_9+$ FCC naphtha introduced via line 12 and hydrogen introduced via line 13. The feed passes through heat exchanger 14 which operates to achieve an outlet temperature of about 600° F. In reactor 10 the feed is contacted with a catalyst of acidic functionality to effectuate hydrodealkylation and transalkylation reactions. The reactions are exothermic which will result in a temperature rise along the reactor. The products of reaction are withdrawn from the reactor via line 15 and passed through heat exchanger 16 to cool the reactor effluent to about 300° F. Hydrogen can be separated from the reactor effluent via separator 21 for recycle to the reactor 10. The product is then passed to fractionator 17 via line 18 from which the gasoline boiling range product is withdrawn. Optionally, any remaining $C_9+$ hydrocarbons can be recycled back to the process by combining them with the feed, preferably the reformate feed, via line 19 and any $C_6$ hydrocarbons, which includes benzene, can also be recycled to the reactor via line 20. The same fractionator can be used to fractionate the reformate and/or FCC gasoline. Depending upon the conversion rate multiple reaction beds with interquench or intercoolers can be used. Heavy reformate and/or FCC gasoline may be used as quench.

EXAMPLES

The following examples illustrate the operation of the process. In these examples, parts and percentages are by weight unless they are expressly stated to be on some other basis. Temperatures are in °F. and pressures in psig, unless expressly stated to be on some other basis. In all the examples conversions were conducted over an unsteamed HZSM-5 catalyst.

Comparison Examples (FCC Naphtha only)

The process was operated with a hydrofinished FCC naphtha which was processed as described in U.S. Ser. No. 07/745,311, filed on Aug. 15, 1991, and U.S. Ser. No. 07/850,106, filed on Mar. 12, 1992. The properties of this naphtha are reported in Table 1.

TABLE 1

| Heavy FCC Naphtha | |
|---|---|
| Composition, wt % | |
| $C_3+C_4$'s | 1.46 |
| $C_5$'s | 1.90 |
| $C_6$'s | 1.49 |
| BENZENE | 0.70 |
| $C_7$'s | 1.18 |
| N—$C_7$'s | 0.25 |
| TOLUENE | 1.95 |
| $C_8$'s | 5.64 |
| $C_9$+'s | 85.13 |
| R + O | 95.50 |
| NITROGEN, PPM | 5.00 |
| SULFUR, PPM | 650.00 |

The following Table 2 sets forth conditions of operation and the results.

TABLE 2

| Conversion of Hydrofinished FCC Naphtha | |
|---|---|
| Temperature, °F. | 776.00 |
| Pressure, psig | 200.00 |
| WHSV | 2.00 |
| $H_2$/HC | 4/1 |
| Product Dist., Wt. % | |
| $C_6$− | 17.23 |
| BENZENE | 2.45 |
| $C_7$'s | 0.68 |
| TOLUENE | 6.30 |
| $C_8$'s | 7.32 |
| $C_9$+'s | 66.00 |
| Conversion, wt. % | |
| Total | 21.29 |
| $C_{10}$+ | 20.79 |
| R + O | 101.20 |
| NITROGEN, PPM | 1.00 |
| SULFUR, PPM | 36.00 |

As demonstrated by the data, conversion over HZSM-5 under the conditions of the test resulted in an overall reduction in the sulfur content of the product. The octane number was significantly enhanced under mild pressure conditions. The proportion of toluene and $C_8$'s increased over the feed while the $C_9$'s decreased.

Example of Reformate Heavy Naphtha and FCC Heavy Naphtha Combined Feed

A reformate and the FCC naphtha feeds described in Table 1 were combined in a 2/1 weight ratio to achieve a feedstock having the properties set out in the following Table 3.

TABLE 3

| 2/1 Ratio Reformate/Hydrofinished FCC Naptha | |
|---|---|
| $C_6$−'s | 1.55 |
| BENZENE | 0.23 |
| $C_7$'s | 0.48 |
| TOLUENE | 0.64 |
| $C_8$'s | 0.45 |
| $C_8$ Aromatics | 3.68 |
| $C_9$+'s | 92.97 |
| NITROGEN, PPM | <1.00 |
| SULFUR, PPM | 260.00 |
| R + O | 100.80 |
| M + O | 91.10 |

The above feed was treated over the HZSM-5 catalyst. The following Table 4 sets forth the conditions of operation and the results.

TABLE 4

| Conversion of 2/1 Ratio Reformate/Hydrofinished FCC Naphtha | |
|---|---|
| Temperature, °F. | 749.00 |
| Pressure, psig | 600.00 |
| WHSV | 1.99 |
| $H_2$/HC | 4/1 |
| Product Dist., Wt. % | |
| $C_6$− | 14.75 |
| BENZENE | 4.25 |
| $C_7$ | 0.07 |
| N—$C_7$ | 0.00 |
| TOLUENE | 14.96 |
| $C_8$ | 0.11 |
| N—$C_8$ | 0.00 |
| $C_8$ Aromatic | 18.59 |
| $C_9$+'s | 47.27 |
| Total wt. % Conversion | 47.17 |
| Wt. % $C_1$–$C_4$ made | 13.47 |
| NITROGEN, PPM | <1.00 |
| SULFUR, PPM | 11.00 |
| R + O | 105.70 |

As demonstrated by the data of Table 4, conversion over HZSM-5 under the conditions of the test resulted in an overall reduction in the sulfur content of the product. The octane number was significantly enhanced by about 5 research octane numbers under the conditions of the test, this exceeded the octane increase exhibited by treating the FCC naphtha in the absence of reformate.

Comparing the data of Tables 3 and 4, a dramatic increase in toluene and $C_8$ aromatics was demonstrated. This was accompanied by a significant decrease in $C_9$+ hydrocarbons. Although the production of naphthalenes contributed to an increase in $T_{90}$ over the feed, this occurred along with an increase in gasoline boiling range materials over that of the feed. Thus, separation of the naphthalenes would result in a gasoline boiling range fraction having a lower $T_{90}$ than the feed.

Example of Feed Containing 85 Weight % Combined Reformate Heavy Naphtha/FCC Heavy Naphtha and 15 Wt. % Benzene In this test 85 wt. % of a 2/1 ratio reformate/FCC naphtha as described in Table 4 was combined with 15 wt. % benzene to achieve a feedstock having the properties set out in the following Table 6.

TABLE 6

| 85 wt. % 2/1 Ratio Reformate/FCC Naptha and 15 wt. % Benzene | |
|---|---|
| $C_6$– | 0.98 |
| BENZENE | 15.93 |
| $C_7$'s | 0.46 |
| TOLUENE | 0.63 |
| $C_8$'s | 0.37 |
| $C_8$ Aromatics | 3.02 |
| $C_9$+'s | 78.61 |

The above feed was treated over the HZSM-5 catalyst described in Table 2. The following Table 7 sets forth the conditions of operation and the results.

TABLE 7

| Conversion of 85 wt. % 2/1 Ratio Reformate/FCC Naphtha and 15 wt. % Benzene | |
|---|---|
| Temperature, °F. | 850.00 |
| Pressure, psig | 600.00 |
| WHSV | 2.00 |
| $H_2$/HC | 4/10 |
| Product Dist., Wt. % | |
| $C_6$– | 14.46 |
| BENZENE | 11.88 |
| CYCLO-$C_6$ | 0.00 |
| $C_7$'s | 0.01 |
| TOLUENE | 21.55 |
| $C_8$'s | 0.06 |
| $C_8$ Aromatics | 16.93 |
| $C_9$+'s | 35.12 |
| CONVERSION, WT. % | 48.91 |
| Total | |

Comparing Table 7 with Table 6, a decrease in benzene content is shown which is desirable. This was accompanied by an increase in toluene and $C_8$ aromatics and a decrease in $C_{9+}$. These data show that the process would be an effective way to treat high benzene streams while converting heavier hydrocarbons to more valuable gasoline boiling range products.

What is claimed is:

1. A process for making light products from a catalytically cracked heavy naphtha and a reformate heavy naphtha fraction both containing a significant proportion of $C_9$ to $C_{13}$ hydrocarbons, comprising the steps of:

a) feeding the catalytically cracked heavy naphtha and the reformate heavy naphtha to a reaction zone; and b) processing the feed fractions in the same reaction zone as step a) over a catalyst of acidic functionality under conditions of elevated temperature ranging from about 500° F. to about 1,000° F. and elevated pressure to convert the feed to a product comprising a hydrocarbon fraction having a larger proportion of hydrocarbons boiling in the gasoline boiling range than the catalytically cracked heavy naphtha and the reformate heavy naphtha feeds.

2. The process as claimed in claim 1 in which said feed fractions have a boiling range within the range of about 212° to 650° F.

3. The process as claimed in claim 1 in which the catalyst of acidic functionality comprises an intermediate pore size zeolite.

4. The process as claimed in claim 1 in which the catalyst of acidic functionality comprises a zeolite having the topology of ZSM-5 or zeolite beta.

5. The process as claimed in claim 4 in which the zeolite is in the aluminosilicate form.

6. The process as claimed in claim 1 in which the product comprises benzene, toluene and xylenes.

7. The process as claimed in claim 1 in which the feed fractions have a boiling range within the range of about 280° to 450° F.

8. The process of claim 1 in which the catalytically cracked heavy naphtha of step (a) is hydrotreated.

9. The process of claim 4 in which the zeolite is an unsteamed zeolite having the topology of ZSM-5 or zeolite beta.

10. The process of claim 1 in which the reaction zone of step (b) comprises a plurality of reactors.

11. The process of claim 10 which further comprises cooling zones between the reactors.

12. The process of claim 11 in which the cooling of the cooling zones is accomplished with a reformate fraction or an FCC gasoline fraction.

13. A process for making light products from a sulfur-containing fluid catalytically cracked heavy naphtha and a reformate heavy naphtha said fractions containing at least 60 we. % $C_9$ to $C_{13}$ hydrocarbons, comprising the steps of:

a) cascading the reformate heavy naphtha fraction from a catalytic reforming zone to a reaction zone;

b) cofeeding the fluid catalytically cracked heavy naphtha fraction to the reaction zone; and c) processing the reformate heavy naphtha and the fluid catalytically cracked heavy naphtha feed fractions in the same reaction zone as step b) over a catalyst of acidic functionality under conditions of elevated temperature ranging from about 500° F. to about 1000° F. and elevated pressure to produce a product comprising a hydrocarbon fraction containing a larger proportion of hydrocarbons boiling in the gasoline boiling range than the feeds and having a reduced sulfur content.

14. The process as claimed in claim 13 in which said feed fractions have a boiling range within the range of 212° to 650° F.

15. The process as claimed in claim 13 in which the acidic catalyst comprises an intermediate pore size zeolite.

16. The process as claimed in claim 13 in which the acidic catalyst comprises a zeolite having the topology of ZSM-5 or zeolite beta.

17. The process as claimed in claim 16 in which the zeolite is an unsteamed zeolite having the topology of ZSM-5 or zeolite beta.

18. The process as claimed in claim 13 in which the zeolite is in the aluminosilicate form.

19. The process as claimed in claim 13 in which the product comprises benzene, toluene and xylene.

20. The process as claimed in claim 13 in which the feed fractions have a boiling range within the range of about 280° to about 450° F.

21. The process as claimed in claim 13 in which the proportion of fluid catalytically cracked naphtha-to-reformate ranges from about 0.2–5.

22. The process as claimed in claim 13 which further comprises separating the gasoline boiling range hydrocarbons from the process of step (c) by fractionation.

23. The process of claim 22 in which the step of separating occurs in a reformer fractionator.

24. A process for making light products from a catalytically cracked heavy naphtha containing a major proportion of methyl branched aromatic hydrocarbons, comprising the steps of:

a) cascading a reformate heavy naphtha containing a major proportion of ethyl and higher alkyl branched aromatic hydrocarbons from a catalytic reforming zone to a reaction zone;

b) cofeeding the fluid catalytically cracked heavy naphtha containing a major proportion of methyl branched aromatic hydrocarbons to the reaction zone; and c) processing the reformate heavy naphtha and the fluid catalytically cracked heavy naphtha in the same reaction as step b) over a catalyst of acidic functionality under conditions of elevated temperature ranging from about 500° F. to about 1000° F. and elevated pressure to convert the naphthas to a product comprising a fraction having a larger proportion of hydrocarbons boiling in the gasoline boiling range than the feeds.

25. The process as claimed in claim 24 in which said feeds have a boiling range within the range of about 212° to 650° F.

26. The process as claimed in claim 1 which further comprises the step of hydrotreating both heavy naphthas prior to step a) to remove sulfur impurities.

27. The process as claimed in claim 1 which further comprises the step of recovering a benzene-containing stream from the product of step b) and recycling the benzene-containing stream to step a).

28. The process as claimed in claim 1 which further comprises the step of cofeeding in step a) a benzene-rich stream.

29. The process as claimed in claim 24 which further comprises the step of cofeeding in step b) a benzene-rich stream.

* * * * *